US008974297B2

(12) United States Patent
Massing et al.

(10) Patent No.: US 8,974,297 B2
(45) Date of Patent: Mar. 10, 2015

(54) RECONFIGURABLE GAMING DISPLAYS AND GAMING TERMINALS WITH RECONFIGURABLE DISPLAY DEVICES

(75) Inventors: Scott A. Massing, Lincolnwood, IL (US); Frank E. Rodriguez, Chicago, IL (US); Timothy C. Loose, Chicago, IL (US); James M. Rasmussen, Chicago, IL (US); Kenneth M. Ross, Chicago, IL (US); Miguel A. Vega, Chicago, IL (US); Michael R. Bytnar, Naperville, IL (US)

(73) Assignee: WMS Gaming Inc., Waukegan, IL (US)

( * ) Notice: Subject to any disclaimer, the term of this patent is extended or adjusted under 35 U.S.C. 154(b) by 39 days.

(21) Appl. No.: 13/404,158

(22) Filed: Feb. 24, 2012

(65) Prior Publication Data

US 2012/0220353 A1 Aug. 30, 2012

Related U.S. Application Data

(60) Provisional application No. 61/447,424, filed on Feb. 28, 2011, provisional application No. 61/549,028, filed on Oct. 19, 2011.

(51) Int. Cl.
*A63F 9/24* (2006.01)
*G07F 17/32* (2006.01)

(52) U.S. Cl.
CPC ..... *G07F 17/3213* (2013.01); *G07F 17/3216* (2013.01); *G07F 17/3227* (2013.01)
USPC ..... 463/31; 463/46

(58) Field of Classification Search
CPC ..... G07F 17/3216; G07F 17/3211; G07F 17/3213
USPC ..... 463/31, 46
See application file for complete search history.

(56) References Cited

U.S. PATENT DOCUMENTS

| | | | | |
|---|---|---|---|---|
| 4,756,580 | A | 7/1988 | Middleton, Jr. | |
| 5,537,290 | A | 7/1996 | Brown et al. | 361/679.06 |
| 5,765,797 | A | 6/1998 | Greene et al. | 248/398 |
| 5,813,914 | A | 9/1998 | McKay et al. | |
| 6,134,103 | A | 10/2000 | Ghanma | 361/679.05 |
| 6,280,328 | B1 | 8/2001 | Holch et al. | 463/42 |
| 6,315,666 | B1 | 11/2001 | Mastera et al. | 463/31 |
| 6,517,433 | B2 | 2/2003 | Loose et al. | 463/20 |
| 6,646,695 | B1 | 11/2003 | Gauselmann | 349/58 |
| 7,217,189 | B2 | 5/2007 | Kaminkow | |
| 7,387,572 | B2 | 6/2008 | Hanchar | 463/46 |
| 7,438,641 | B2 | 10/2008 | Hedrick | 463/30 |
| 7,513,830 | B2 | 4/2009 | Hajder et al. | 463/46 |

(Continued)

FOREIGN PATENT DOCUMENTS

| | | | |
|---|---|---|---|
| DE | 4211311 | 10/1993 | A63F 13/08 |
| WO | WO/2007/089410 | 8/2007 | A63F 9/24 |

*Primary Examiner* — Dmitry Suhol
*Assistant Examiner* — Carl V Larsen
(74) *Attorney, Agent, or Firm* — Nixon Peabody LLP

(57) ABSTRACT

Gaming terminals, gaming machines, gaming systems, and methods of reconfiguring a display device are presented herein. A gaming terminal for playing a wagering game is disclosed, which includes an input device configured to receive a wager to play the wagering game, a cabinet, and a display device operatively mounted to the cabinet. The display device has an electronic graphical display screen that is operable to dynamically display information related to the wagering game. The display screen is configured to physically change shape and/or size.

25 Claims, 8 Drawing Sheets

(56) References Cited

U.S. PATENT DOCUMENTS

| | | | | |
|---|---|---|---|---|
| 7,540,806 | B2 | 6/2009 | Tastad | 463/46 |
| 7,566,269 | B2 | 7/2009 | B-Jensen et al. | 463/20 |
| 7,611,408 | B2 | 11/2009 | Martin et al. | 463/29 |
| 7,644,922 | B2 | 1/2010 | Fiden et al. | |
| 7,775,888 | B2 | 8/2010 | Wudtke | 463/46 |
| 7,780,534 | B2 | 8/2010 | Wudtke | 463/46 |
| 2003/0045354 | A1 | 3/2003 | Giobbi | 463/40 |
| 2003/0060269 | A1 | 3/2003 | Paulsen et al. | 463/20 |
| 2003/0060270 | A1* | 3/2003 | Binkley et al. | 463/20 |
| 2004/0053658 | A1 | 3/2004 | Rothranz | 463/16 |
| 2004/0147300 | A1 | 7/2004 | Seelieg et al. | 463/1 |
| 2004/0248647 | A1 | 12/2004 | Rothschild et al. | |
| 2004/0248648 | A1 | 12/2004 | Rothschild et al. | 463/31 |
| 2005/0003879 | A1 | 1/2005 | Jaffe et al. | |
| 2005/0020348 | A1 | 1/2005 | Thomas et al. | 463/20 |
| 2005/0049028 | A1 | 3/2005 | Gornez et al. | 463/20 |
| 2005/0192090 | A1 | 9/2005 | Muir et al. | |
| 2005/0197181 | A1 | 9/2005 | Jaffe | 463/20 |
| 2005/0277477 | A1 | 12/2005 | Hajder et al. | |
| 2006/0014580 | A1 | 1/2006 | Hawthorn | 463/20 |
| 2006/0160598 | A1 | 7/2006 | Wells et al. | 463/16 |
| 2006/0183544 | A1 | 8/2006 | Okada | 463/31 |
| 2006/0277805 | A1 | 12/2006 | Kopera et al. | 40/584 |
| 2007/0004513 | A1* | 1/2007 | Wells et al. | 463/31 |
| 2007/0040084 | A1* | 2/2007 | Sturman et al. | 248/280.11 |
| 2007/0111776 | A1* | 5/2007 | Griswold et al. | 463/16 |
| 2007/0171639 | A1* | 7/2007 | Ward et al. | 362/231 |
| 2008/0113821 | A1 | 5/2008 | Beadell et al. | 463/46 |
| 2008/0227526 | A1 | 9/2008 | Crossman et al. | 463/20 |
| 2009/0036197 | A1 | 2/2009 | Anderson et al. | 463/20 |
| 2009/0137311 | A1 | 5/2009 | Iverson et al. | 463/20 |
| 2009/0325692 | A1 | 12/2009 | Klostermann et al. | 463/30 |
| 2010/0210354 | A1 | 8/2010 | Burak et al. | 463/25 |
| 2010/0317433 | A1 | 12/2010 | Ansari et al. | 463/30 |
| 2011/0003630 | A1 | 1/2011 | Rasmussen et al. | 463/20 |
| 2011/0102889 | A1* | 5/2011 | Raja | 359/451 |
| 2012/0122569 | A1* | 5/2012 | Kowolik et al. | 463/30 |

* cited by examiner

RECONFIGURABLE GAMING DISPLAYS AND GAMING TERMINALS WITH RECONFIGURABLE DISPLAY DEVICES

CROSS-REFERENCE AND CLAIM OF PRIORITY TO RELATED APPLICATION

This application claims the benefit of and priority to U.S. Provisional Patent Application No. 61/447,424, filed Feb. 28, 2011, and U.S. Provisional Patent Application No. 61/549,028, filed Oct. 19, 2011, both of which are incorporated herein by reference in their respective entireties.

COPYRIGHT

A portion of the disclosure of this patent document contains materials subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to wagering game machines and gaming systems, and more particularly to reconfigurable gaming displays and gaming terminals with reconfigurable display devices.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine, as well as the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators therefore strive to employ the most entertaining and exciting machines, features, and enhancements available because such machines, features, and enhancements attract frequent play and, hence, increase profitability to the operator.

Many gaming machines include a variety of visual attractions and displays, such as models, signs, and other forms of information. These items typically include fixed permanently-printed glass, video displays, artwork, models, and/or marquees. In many gaming regions, industry regulations in fact require each gaming terminal to include top-box mounted lighting and signage that indicate, for example, the class of machine, when the machine is of out of funds, when the machine is malfunctioning, etc.

Historically, each gaming machine was limited to a single game with a dedicated primary display and top-box mounted flat-screen display or marquee assembly. In most configurations, the gaming terminal's various display devices are rigidly mounted to the cabinet in a fixed location, and therefore are limited to providing a single view in a single orientation. Moreover, traditional electronic graphical display devices, such as cathode ray tube (CRT) displays, liquid crystal display (LCD) panels, plasma display panels, and light emitting diode (LED) displays, are rigid and inflexible, having a fixed size and shape, and therefore cannot expand, contract, or change form. There may therefore be a need for reconfigurable gaming display devices that are not limited to a single view, a single orientation, a single size, and/or a single shape.

SUMMARY

According to some aspects of the present disclosure, a gaming terminal for playing a wagering game is featured. The gaming terminal includes an input device for receiving a wager to play the wagering game, a cabinet, and a display device operatively mounted to the cabinet. The display device has an electronic graphical display screen that is operable to dynamically display information related to the wagering game. The display screen is configured to physically change shape and/or size.

According to other aspects of the present disclosure, a gaming system is presented. The gaming system includes at least one input device, at least one processor, at least one memory, a support structure, and a display device. The display device is operatively mounted to the support structure. The display device has an electronic graphical display screen that is operable to dynamically display information related to the wagering game. The display screen is configured to change to different shapes According to another aspect of the present disclosure, a gaming machine for playing a wagering game is disclosed. The gaming machine includes an input device configured to receive a wager to play the wagering game, a cabinet, and a display device mounted to the cabinet. The display device has an electronic graphical display screen that is operable to dynamically display an outcome of a wagering game. The outcome is randomly determined from a plurality of wagering game outcomes. The display screen is configured to transition back-and-forth between a plurality of shapes.

According to even yet another aspect of the present disclosure, a method of reconfiguring a display device of a wagering game terminal is provided. The method includes: providing the display device, which has an electronic graphical display screen that is operable to dynamically display information related to the wagering game, the display screen being configured to change shape and/or size; and applying a force to the display device such that the display screen changes shape and/or size.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and representative modes for carrying out the present disclosure when taken in connection with the accompanying drawings and the appended claims.

Figure 1:
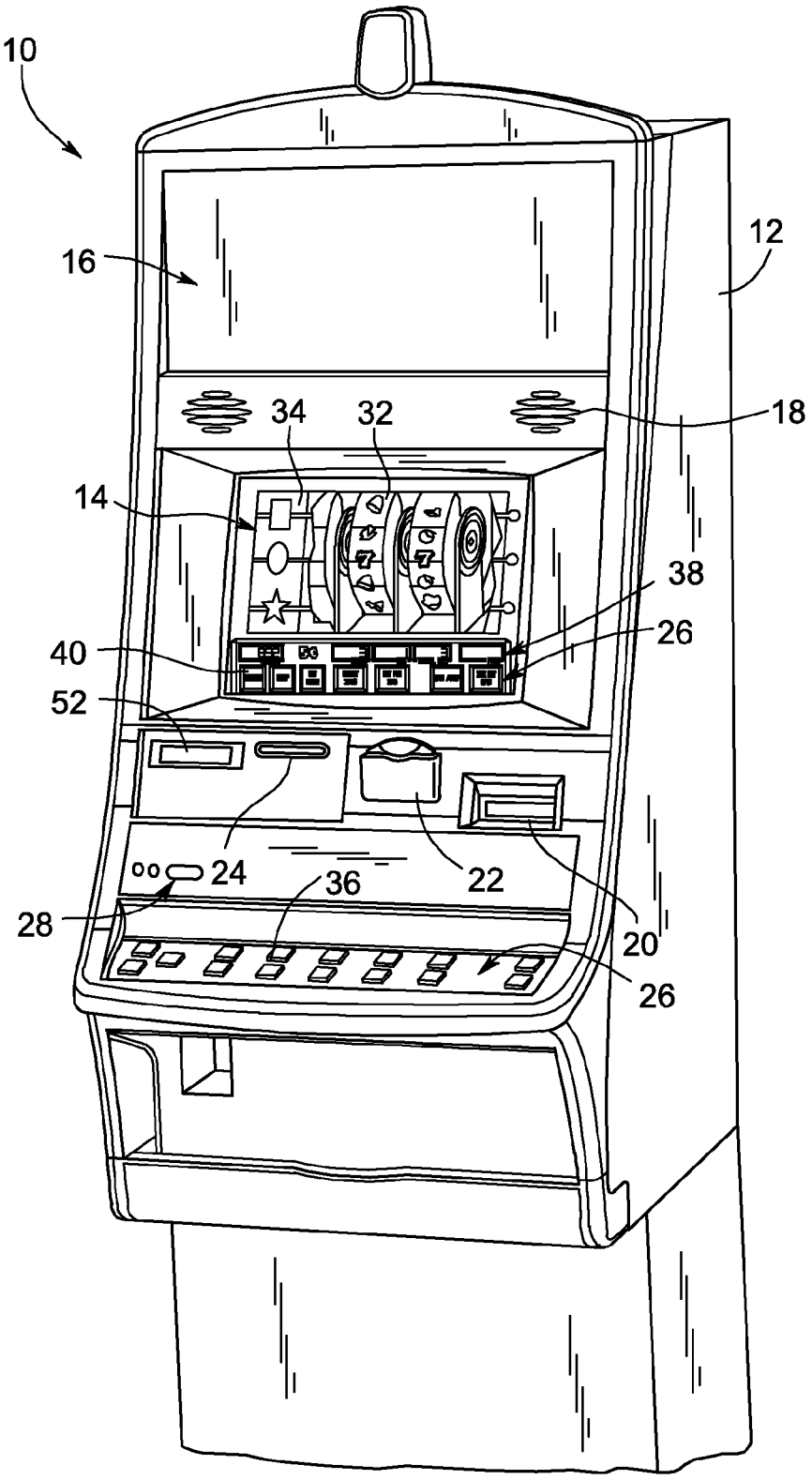
FIG. 1 is a perspective-view illustration of an exemplary free-standing gaming terminal according to aspects of the present disclosure.

While the aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there are shown in the drawings and will herein be described in detail representative embodiments with the understanding that the present disclosure is to be considered as an exemplification of the various aspects and principles of the invention, and is not intended to limit the broad aspect of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present Detailed Description, unless specifically disclaimed, the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein, for example, in the sense of "at, near, or nearly at," or "within 3-5% of," or "within acceptable manufacturing tolerances," or any logical combination thereof.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 can be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
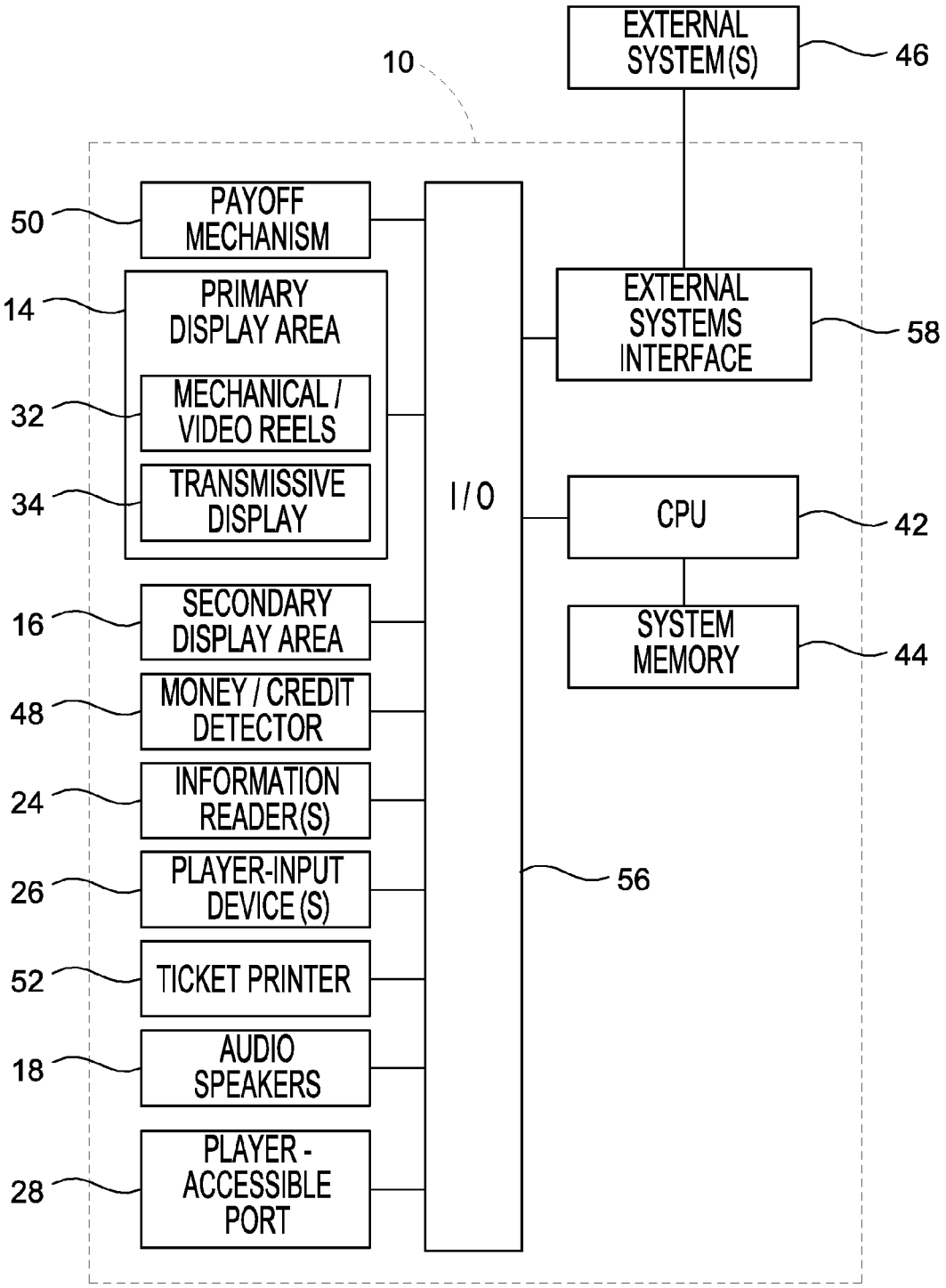
FIG. 2 is a schematic diagram of an exemplary gaming system according to aspects of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel Pentium processor, Intel Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device (s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+front-side bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10 bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
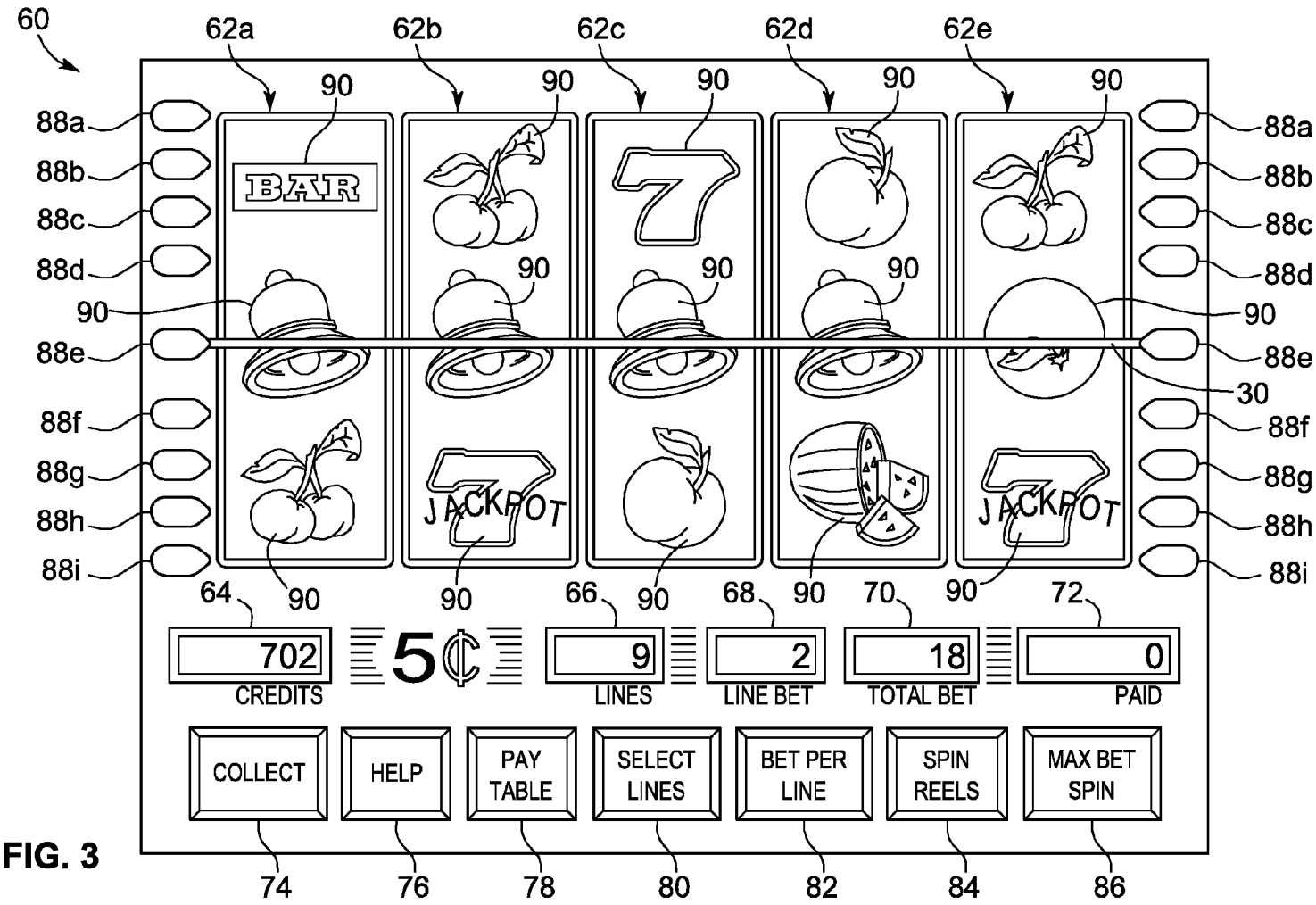
FIG. 3 is a screen shot of a basic-game screen from an exemplary wagering game that can be played, for example, on the gaming terminal of FIG. 1 or the gaming system of FIG. 2.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 4:
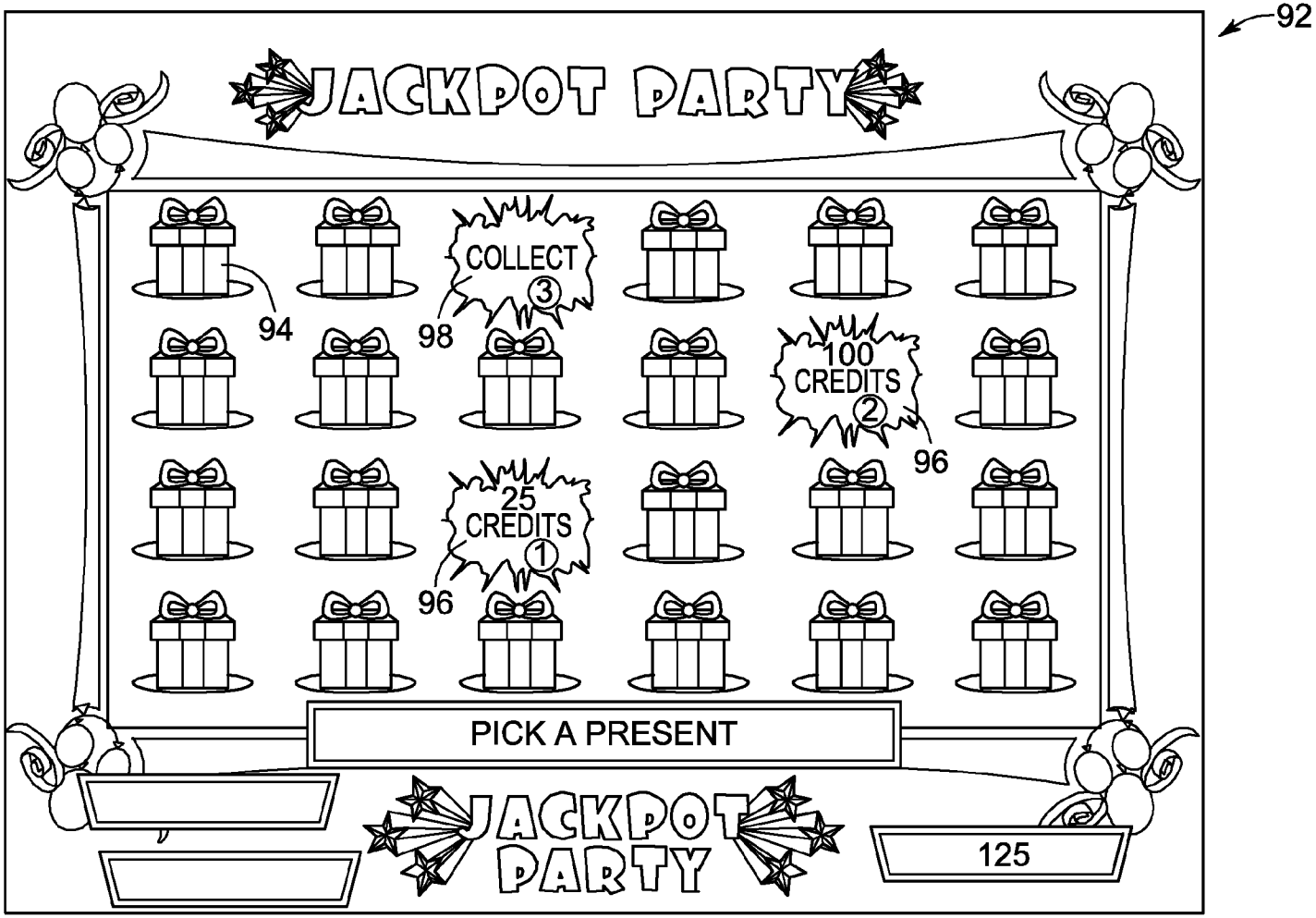
FIG. 4 is a screen shot of a secondary- or bonus-game screen from an exemplary wagering game that can be played, for example, on the gaming terminal of FIG. 1 or the gaming system of FIG. 2.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

FIGS. 5A-5D provide perspective-view illustrations of an exemplary gaming terminal, designated generally at 510, for playing one or more wagering games. Although differing in appearance, the gaming terminal 510 can be similar in function, operation and connectivity to the gaming terminal 10 discussed above with respect to FIGS. 1 and 2. For example, the gaming terminal 510 (also referred to herein as "wagering game machine" or "gaming machine") may be an electromechanical gaming terminal configured, for example, to play mechanical slots, or it may be an electronic gaming terminal configured, for example, to play a video casino game, such as keno, poker, slots, blackjack, roulette, etc. Markedly, the gaming terminal 510 is purely representative in nature, and presented solely for explanatory purposes.

The illustrated gaming terminal 510 comprises a cabinet 512 for housing and/or supporting a variety of operational componentry (e.g., a CPU 42, a memory 44, an external systems interface 58, etc.). For output devices, the gaming terminal 510 includes a primary display area (or "first display device") 514, a secondary display area (or "second display device") 516, and one or more audio speakers 518. For input devices, the gaming terminal 510 may include a bill-receiving and validating device 520, a coin acceptor (not shown), one or more information readers 524, and one or more player-input devices, which are collectively represented by a touch-screen button panel 522 on the second display device 516. In alternative embodiments, the second display device 516 may include, or be replaced by, a button panel arrangement (e.g., button panel 36 of FIG. 1) or other player input device. While these typical components found in the gaming terminal 510 are described above, it should be understood that numerous additional/alternative peripheral devices and other elements may exist and may be used in any number of combinations to create various forms of a gaming terminal.

The primary display device 514 (also referred to herein as "reconfigurable display device") is operatively mounted to the cabinet, for example, via a support assembly, such as the repositionable mounting assembly 750 described below with respect to FIG. 7 or the repositionable mounting assembly 850 described below with respect to FIGS. 8A and 8B. The primary display device 514 has an electronic graphical display screen 526 that is operable to dynamically display information related to the wagering game. As used herein, the term "electronic graphical display screen" should be defined or interpreted as inclusive of, but not exclusive to, display devices that create visual images, both moving and stationary alike, through the electronic generation and manipulation of light. By way of non-limiting example, the display screen 526 may include an organic light emitting diode (OLED) panel. One such OLED display panel is the AMOLED screen, which is manufactured by LG Display Co., Ltd., of Seoul, South Korea. In another optional configuration, the display screen 526 may include an organic thin-film transistor (OTFT) display panel, which may be integrated with OLED technology. One such OTFT display is the Rollable OTFT-Driven OLED Panel, which is manufactured by Sony Corp., of Tokyo, Japan. In yet another optional configuration, the display screen 526 includes a light emitting diode (LED) tube display comprising a plurality of juxtaposed LED tubes. One such LED tube display is the LED Tube Screen, which is manufactured by Zhuhai Ltech Electronic Technology Co., Ltd., of Guangdong Province, China. As used herein, the term "electronic graphical display screen" should not be defined or interpreted as consisting of a projector screen or an electromechanically automated exhibit, such as moving marquees and mechanized cabinet ornaments.

Figures 5A, 5B, 5C, 5D:
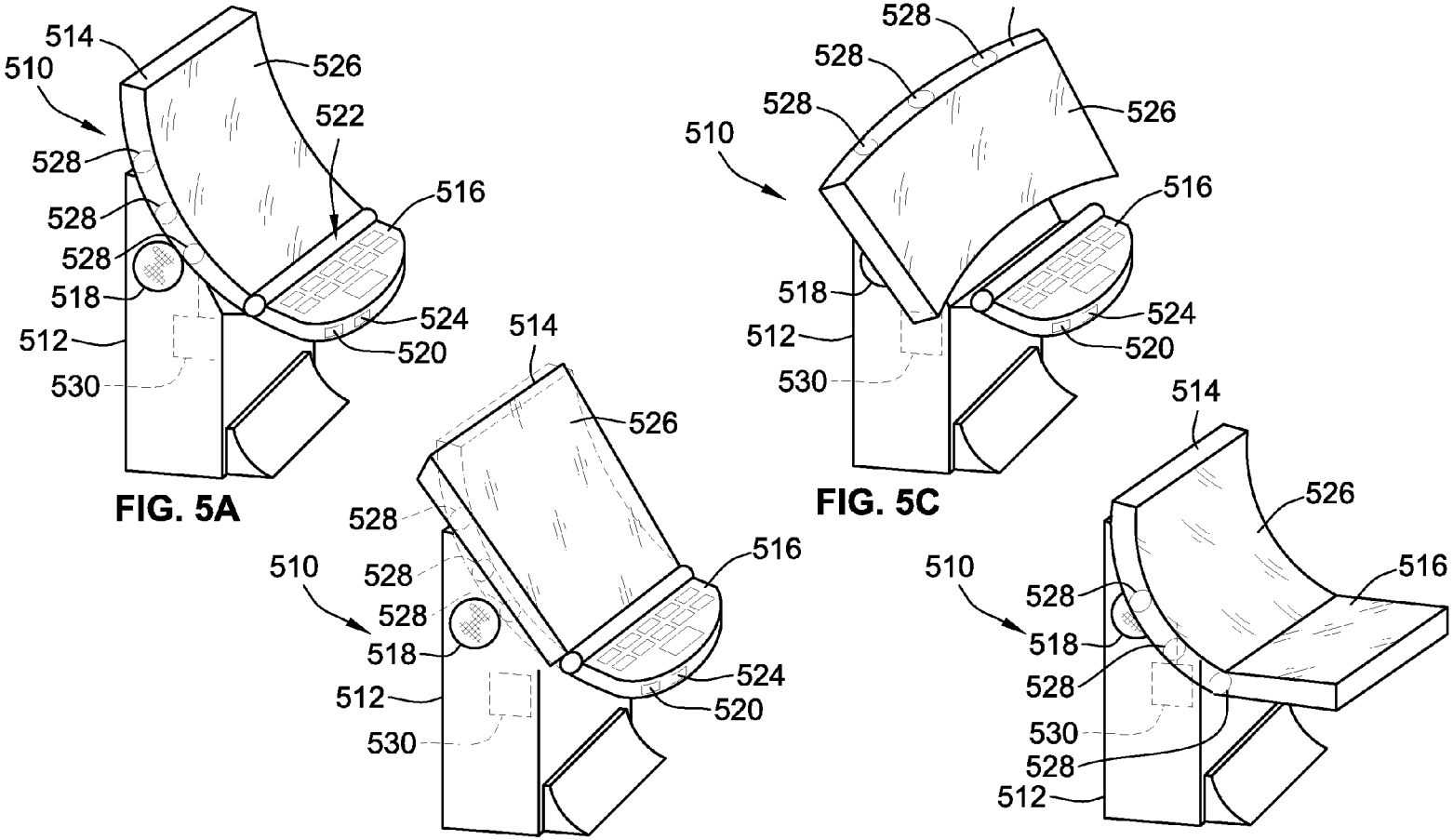
FIG. 5A is a perspective-view illustration of an exemplary gaming terminal with a reconfigurable display device in accordance with aspects of the present disclosure, showing the reconfigurable display device in an upright position, with a partially curved configuration, in a portrait-view orientation.
FIG. 5B is a perspective-view illustration of the exemplary gaming terminal of FIG. 5A, showing the reconfigurable display device in an upright position, with a generally flat configuration, in a portrait-view orientation.
FIG. 5C is a perspective-view illustration of the exemplary gaming terminal of FIG. 5A, showing the reconfigurable display device in an upright position, with a partially curved configuration, in a landscape-view orientation.
FIG. 5D is a perspective-view illustration of the exemplary gaming terminal of FIG. 5A, showing the reconfigurable display device relocated to a slant-top position, with a partially flat and partially curved configuration, in a portrait-view orientation.

The display screen 526 is designed to physically change shape and/or size. In the embodiment of FIGS. 5A-5D, for example, the display screen 526 is configured to transition back-and-forth between a plurality of shapes. The display screen 526 can be changed, for example, from a generally arcuate shape, as shown in FIG. 5A, to a generally flat shape, as shown in FIG. 5B. Additional or alternative shapes are also envisioned, including spherical and semi-spherical shapes, conical and frusta-conical shapes, sinusoidal and other wave-shaped patterns, etc. In an exemplary configuration where the display screen 526 is an OLED panel, the emissive electroluminescent layer, which is a film of organic compounds that emit light in response to an electric current, can be fabricated on a flexible plastic or metallic substrate. In so doing, the flexible OLED panel can be curved, bent, and/or folded without distorting or skewing the displayed image. In an alternative configuration where the display screen 526 includes an LED tube display, each of the LED tubes is an independently driven array of LEDs. When juxtaposed, the LED tubes are modulated in unison to collaboratively create the displayed image. As such, the LED tubes can be moved relative to one another, thereby changing the overall shape of the display screen, without distorting or skewing the displayed image.

The display device 514 also includes a supporting frame structure, which is schematically illustrated at 528 in FIGS. 5A-5D. The supporting frame structure 528 is designed to provide the structural support necessary to retain the display screen 526 in the curved configuration (FIG. 5A) and the flat configuration (FIG. 5B), or any of the other various/alternative shapes into which the display screen 526 can be changed. In some embodiments, the supporting frame structure 528 comprises an internal rail-and-track system (not shown), which includes a plurality of transversely oriented support rails that provide the aforementioned structural support for the display screen 526. The support rails are repositionable (e.g., slidable) along one or more guide tracks. In this instance, changing the shape of the display screen 526 merely requires sliding the support rails from one section of track, which provides a first shape, to a second section of track, which provides a second, different shape. In an alternate embodiment, the supporting frame structure 528 comprises an external truss-and-cable suspension system (not shown), which includes a weight-bearing truss that is interconnected with the display screen 526 via an array of suspension cables. In this instance, changing the shape of the display screen 526 only requires changing the distance between the truss and display screen 526 by varying the length of one or more of the suspension cables.

According to another exemplary configuration, the supporting frame structure 528 comprises one or more active material substrates. Active materials include those compositions having certain properties, such as shape and dimension, that can be selectively altered through the introduction of an external stimuli or "activation signal", such as external stresses, temperature, moisture, and pH changes, and electric or magnetic fields, depending upon the type of active material. Two common types of active materials are piezoelectric materials and electroactive polymers. Piezoelectric materials are materials, traditionally crystalline structures and ceramics, which produce a mechanical stress when a voltage is applied thereto. Suitably designed supporting frame structures fabricated from these materials can therefore be made that bend, expand, or contract when a voltage is applied thereto. Electroactive Polymers, or more commonly "EAPs," include those polymeric materials which respond to external electrical stimulation by displaying a significant shape or size displacement. Consequently, EAPs are capable of converting energy in the form of electric charge and voltage to mechanical force and movement and vice versa. EAPs can be divided in two primary classes: dielectric EAPs, in which actuation is caused by electrostatic forces between two electrodes which squeeze the polymer; and, ionic EAPs, in which actuation is caused by the displacement of ions inside the polymer. When using an active-material based frame structure 528, changing the shape of the display screen 526 merely requires applying the appropriate stimulus (e.g., electrical charge, voltage, magnetic field, etc.) to the active material substrate.

In some embodiments, the shape/size of the display screen 526 is manually changed, for example, by pulling or pushing on the lateral edges of the display device 514. Alternatively, the change in shape/size of the display screen 526 is automated. By way of example, and not limitation, a driving mechanism, which is schematically illustrated at 530 in FIG. 5A, is configured to mechanize transitioning the display screen back-and-forth between the generally flat shape seen in FIG. 5B and the generally arcuate shape seen in FIG. 5A. Depending, for example, on the reconfigurable shapes of the display screen 526 and the design of the supporting frame structure 528, the driving mechanism 530 may comprise one or more pneumatic or hydraulic cylinders, electrically driven DC or servo motors, linear actuators, etc. As an extension of the foregoing examples, the driving mechanism 530 can be operable to drive the support rails back-and-forth along the guide tracks (i.e., in a rail-and-track arrangement) or to coil/uncoil the suspension cables (i.e., in a truss-and-cable suspension system). Alternatively, the driving mechanism 530 can be in the nature of an active material actuator, which is operable to provide the requisite stimuli for changing the shape of an active-material based frame structure 528. Moreover, the driving mechanism 530 can be operable to relocate and/or reorient the entire primary display device 514, which is explained in further detail below in the discussion of FIGS. 5C and 5D.

In accordance with other embodiments of the present disclosure, the primary display device 514 and, thus, the display screen 526 can change orientation with respect to the cabinet 512 of the gaming terminal 510. In one non-limiting example, FIG. 5A shows the reconfigurable display device 514 in an upright position, where the display screen 526 is generally vertical, and in a portrait-view orientation, where the long side of the display screen 526 lies along the vertical plane running from top to bottom. The display device 526 can be turned, pivoted, or otherwise moved from the portrait-view orientation exemplified in FIG. 5A to a landscape-view orientation, such that the short side of the display screen 526 lies along the vertical plane running from top to bottom, as exemplified in FIG. 5C. Another manner of reorienting the display screen 526 includes tiling, pivoting or otherwise transitioning the display device 514 from the upright orientation illustrated in FIG. 5A to a slant-top orientation, where the display screen 526 is generally horizontal, as exemplified in FIG. 5D. Transitioning the display device 514 from an upright to a slant-top orientation may also include changing the location of the display screen 526 with respect to the cabinet 512 of the gaming terminal 510. In the embodiment of FIG. 5D, for example, the entire primary display device 514 has been moved downward along the cabinet 512. An additional benefit of being able to slide the primary display device 514 downwards toward the player in the manner illustrated in FIG. 5D would be to create an input surface via an integral touch screen, and thereby reduce/remove the need for a button panel.

In some configurations, the display screen 526 is operable to automatically change shape and/or size in response to events in the wagering game, user-input preferences, operator-input preferences, and other game-related and non-game-related occurrences. In one instance, the driving mechanism 530 can be operated to selectively reconfigure (e.g., reshape, relocate, reorient, or a combination thereof) the display screen 526, or selected portions thereof, in response to random events occurring in the wagering game so as to simulate those random events. If the wagering game were to include, for example, a bonus-game feature with an automobile, such as a plane or car, the display screen 526 can be made to change from a portrait-view orientation (FIG. 5A) to a landscape-view orientation (FIG. 5C) and switch from a generally flat configuration (FIG. 5B) to a partially curved configuration (FIG. 5C) to simulate the plane's cockpit window or the car's front windshield. Moreover, during play of the bonus-game feature, the display screen 526 can be made to pitch forward and backward, swing side-to-side, and move up-and-down, for example, to simulate movement of the automobile or to imitate a turbulent plane ride or a jarring car ride.

Optionally, the automation of the display screen 526 can be employed for other gaming and non-gaming functions. According to various aspects of the disclosed concepts, the driving mechanism 530 can respond to signals from a button panel, joystick, or other player input device on the gaming terminal 510, which would allow the player to reconfigure the display screen 526, for example, to meet the player's particular preferences. Some examples include setting the display screen 526 to a particular screen height, moving the display screen 526 from a slant-top to an upright orientation, changing the viewing angle, etc. Optionally, the driving mechanism 530 can respond to signals from an onboard controller (e.g., CPU 42 of FIG. 2), a central controller (e.g., remotely located in the external system 46 depicted in FIG. 2), or other operator input device on the gaming terminal 510 to allow the operator or a central server to reconfigure the display screen 526, for example, to provide new/different gaming features, to implement a display-based "attract mode" to draw new players to the gaming terminal 510, or to meet a particular set of parameters (e.g., to create additional room for adjacent gaming devices). An additional benefit would be to allow the player/operator to adjust the display to reduce/remove glare from environmental lighting, or automatically sense both the player's facial position, and surrounding lighting, and adjust accordingly to reduce such reflection.

Figure 6C:
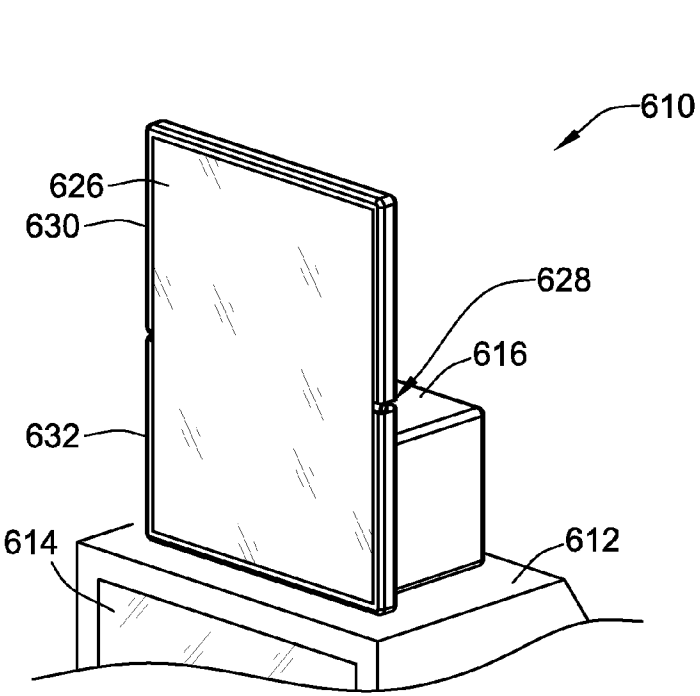
FIG. 6C is a perspective-view illustration of the exemplary gaming terminal of FIG. 6A, showing the reconfigurable display device in an unfolded state and exhibiting a second size that is greater than the first size.
Figure 6A:
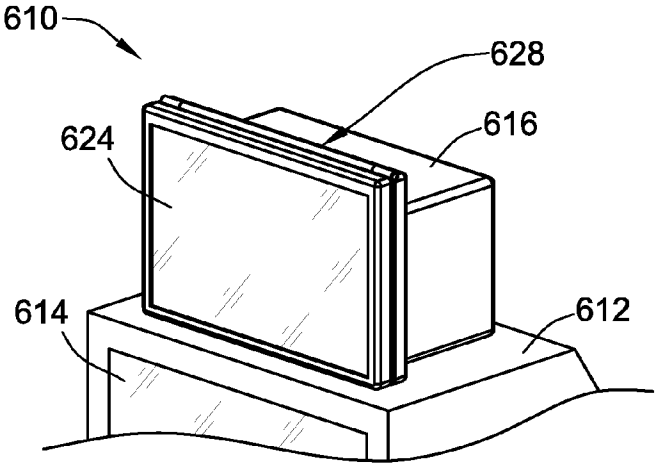
FIG. 6A is a perspective-view illustration of another exemplary gaming terminal with a reconfigurable display device in accordance with aspects of the present disclosure, showing the reconfigurable display device in a folded state and exhibiting a first size.
Figure 6B:
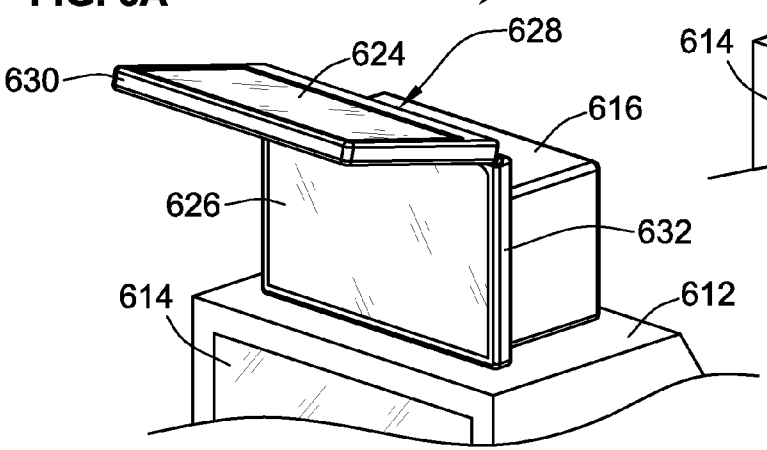
FIG. 6B is a perspective-view illustration of the exemplary gaming terminal of FIG. 6A, showing the reconfigurable display device in a partially unfolded state.

FIGS. 6A-6C illustrate another exemplary gaming terminal, designated generally at 610, in accordance with other aspects of the present disclosure. Although differing in appearance, the gaming terminal 610 can be similar in function, operation and connectivity to the gaming terminal 10 discussed above with respect to FIGS. 1 and 2. As such, the gaming terminal 610 can include any of the features described above with respect to the assorted embodiments set forth in FIGS. 1-5D. The illustrated gaming terminal 610 comprises a cabinet 612, a primary display area (or "first display device") 614, and a secondary display area (or "second display device") 616. Each display device can be operable to display information associated with wagering games, non-wagering games, advertisements, entertainment, messaging, alerts or announcements, etc. appropriate to the particular mode(s) of operation of the gaming terminal 610. It should be understood that numerous additional/alternative peripheral devices and other elements may exist and may be used in any number of combinations to create various forms of a gaming terminal.

The secondary display device 616 (also referred to herein as "reconfigurable display device") has two electronic graphical display screens—a first display screen 624 and a second display screen 626, each of which is operable to dynamically display information related to the wagering game. The first display screen 624 is, in various embodiments, a high-resolution liquid crystal display (LCD), a plasma display, a light emitting diode (LED), a DLP projection display, an electroluminescent (EL) panel, or any other type of display suitable for use in the gaming terminal 610. In contrast, the second display screen 626 is, in various embodiments, an OLED panel, an OTFT or OTFT-driven display panel, or an LED tube display, or other types of displays suitable for purposes discussed below.

The second display screen 626 of the reconfigurable display device 616 is configured to change shape and size by transitioning from a folded condition or state, which is exemplified in FIG. 6A, to an unfolded condition or state, which is exemplified in FIG. 6C. A supporting frame structure, which is labeled generally as 628 in FIGS. 6A-6C, is designed to provide the structural support necessary to retain the display screen 626 in the folded (FIG. 6A) and unfolded (FIG. 6C) states. In the illustrated embodiment, the supporting frame structure 628 generally consists of a first backing panel 630 that is pivotally hinged and, thus, movable with respect to a second backing panel 632. As seen in FIGS. 6A and 6B, the first display screen 624 lies on a first side of the first backing panel 630. The second display screen 626, in contrast, extends across both the first and second backing panels 630, 632, lying on a second side of the first backing panel 630 opposite the first display screen 624.

When the reconfigurable display device 616 is in the folded condition, the first and second backing panels 630, 632 are juxtaposed and generally parallel to one another such that the first display screen 624 faces forward with respect to the gaming terminal 610, while the second display screen 626 is folded in half, interleaved between the first and second backing panels 630, 632, as seen in FIG. 6A. In this condition, the second display screen 626 has a first shape (e.g., a folded two-ply rectangle) and a first size (e.g., a small or "stowed" area). As seen in FIGS. 6A-6C, the first backing panel 630 can be swung 180 degrees to situate on top of and generally coplanar with the second backing panel 632, thereby transitioning the reconfigurable display device 616 to the unfolded condition illustrated in FIG. 6C. In this condition, the first display screen 624 faces rearward with respect to the gaming terminal 610, while the second display screen 626 faces forward with respect to the gaming terminal 610. Moreover, the second display screen 626 now has a second, different shape (e.g., a flat single-ply rectangle) and a second, different size (e.g., a large or "unfolded" area) than what is provided when the reconfigurable display device 616 is in the folded condition. By having this functionality, the reconfigurable display device 616 is able to provide two different-sized forward-facing display screens—e.g., the area of the first display screen 624 when in the folded state, and the unfolded area of the second display screen 626 when in the unfolded state, which is illustrated as being twice the size of the first display screen 624. In addition, the first display screen 624 can still be active and implemented while the second display screen 626 is fully unfolded, for example, in an "attract mode" to draw other potential players to the gaming device 610.

Figure 7:
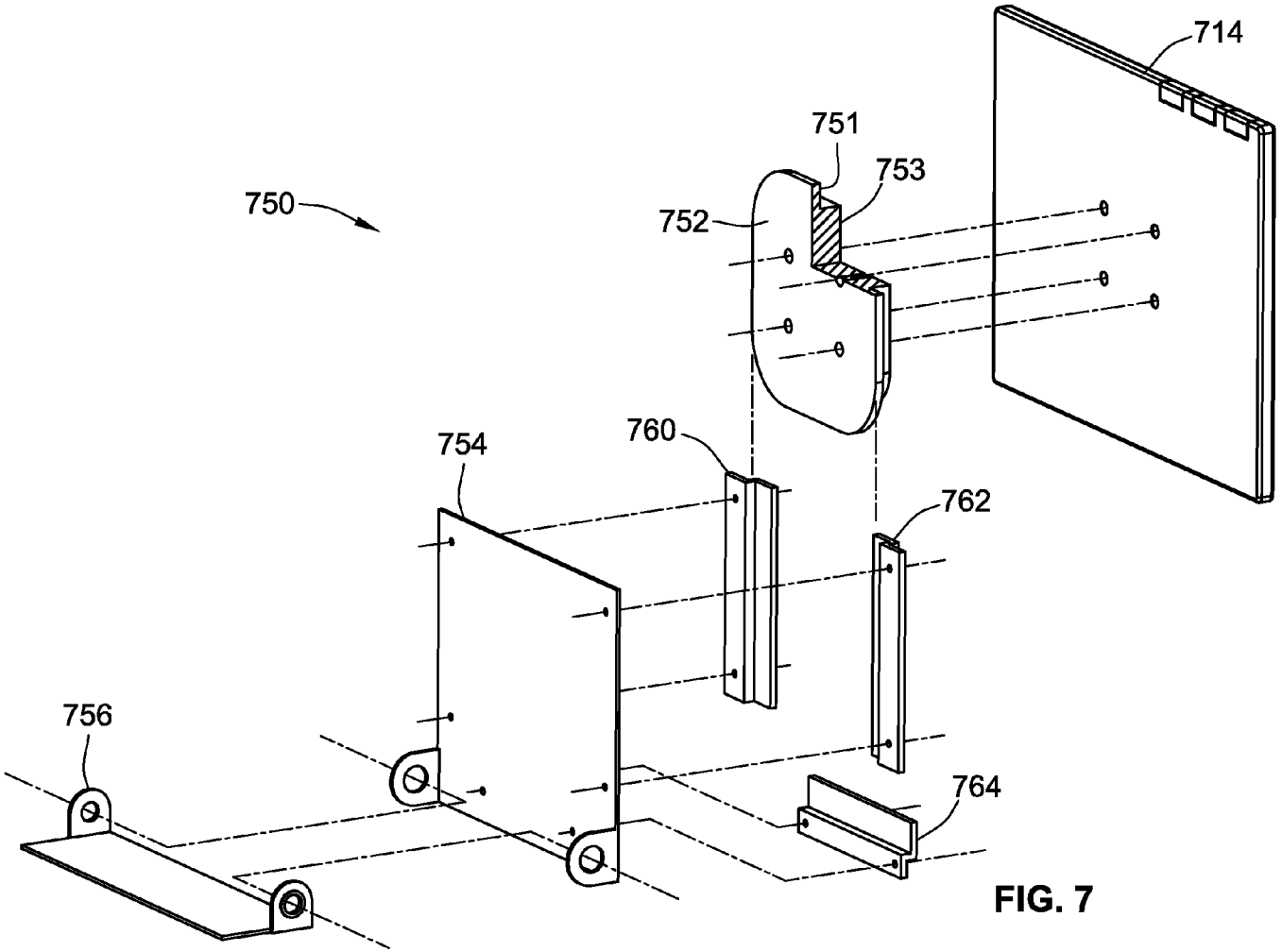
FIG. 7 is a partially exploded, rear perspective-view illustration of a gaming display device with an exemplary gaming display stand in accordance with aspects of the present disclosure.

Turning next to FIG. 7, a representative reconfigurable gaming display device 714 is shown in accordance with other aspects of the present disclosure. Similar to the embodiments discussed above with respect to FIGS. 5A-5D and 6A-6C, the gaming display device 714 of FIG. 7 (also referred to herein as "reconfigurable display device") includes an electronic graphical display screen (not visible in the view provided) that is operable to dynamically display information related to the wagering game. The display screen is, in various embodiments, a high-resolution LCD display panel, a plasma display, an LED display panel, an EL panel, or any other type of suitable display device.

The gaming display device 714 is provided with a gaming display stand (also referred to herein as "mounting assembly"), designated generally as 750, which is configured to repositionably mount the gaming display device 714 to a gaming terminal or other support structure. The display stand 750 includes a mounting disk 752 that attaches (e.g., via threaded fasteners) to a rear surface of the display device 714. Shown partially cut away in FIG. 7, the mounting disk 752 includes a disk-shaped flange portion 751 that projects transversely from a distal end of a base portion 753. The display stand 750 also includes a support plate 754 (also referred to herein as "support arm"), which is configured to pivotably attach to a hinge plate 756, for example, via bushings and pivot pins (not shown). The hinge plate 756, in turn, is mechanically fastened or otherwise attached to a gaming terminal or other support structure such that the display screen 714, through the cooperative engagement of the mounting disk 752, support plate 754 and hinge plate 756, can selectively transition back-and-forth between an upright (e.g., generally vertical) orientation and a slant-top (e.g., generally horizontal) orientation.

A plurality of Z-shaped brackets 760, 762, 764 attach to a proximal surface of the support plate 754, which faces the display device 714. The Z-shaped brackets 760, 762, 764, once attached to the support plate 754, cooperate to create a U-shaped receiving slot that slidably receives therein the flange portion 751 of the mounting disk 752. When the mounting disk 752 is properly seated inside this U-shaped receiving slot that is defined by the brackets 760, 762, 764, the gaming display device 714 can be rotated (e.g., clockwise or counterclockwise) such that the display screen can selectively rotate between different orientations, such as a portrait-view orientation and a landscape-view orientation.

Figure 8B:
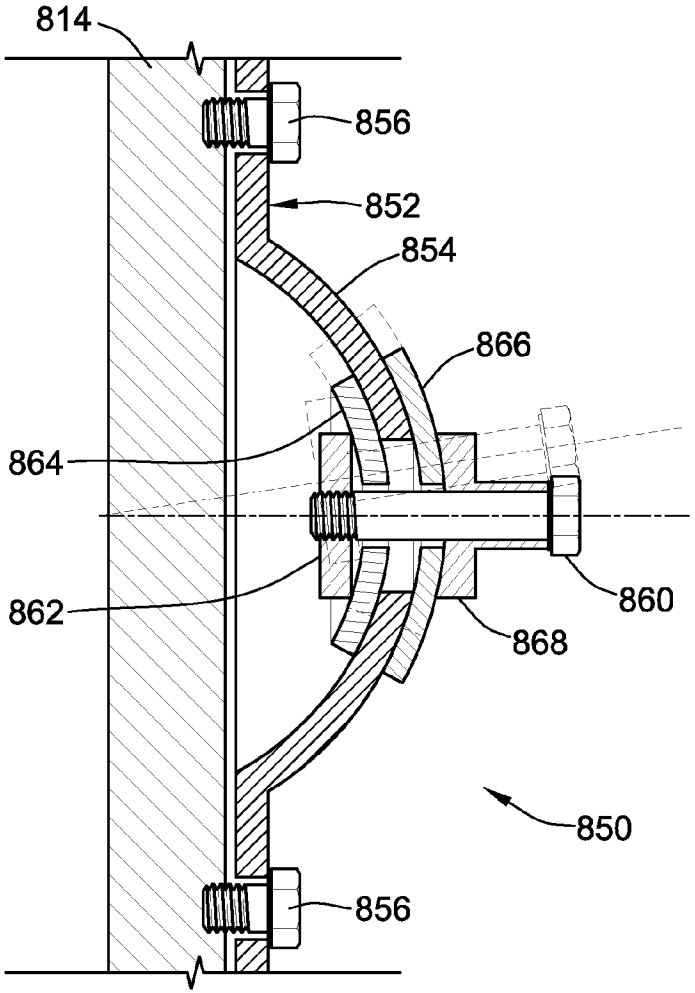
FIG. 8B is a side cross-sectional illustration of the mounting bracket of FIG. 9A.
Figure 8A:
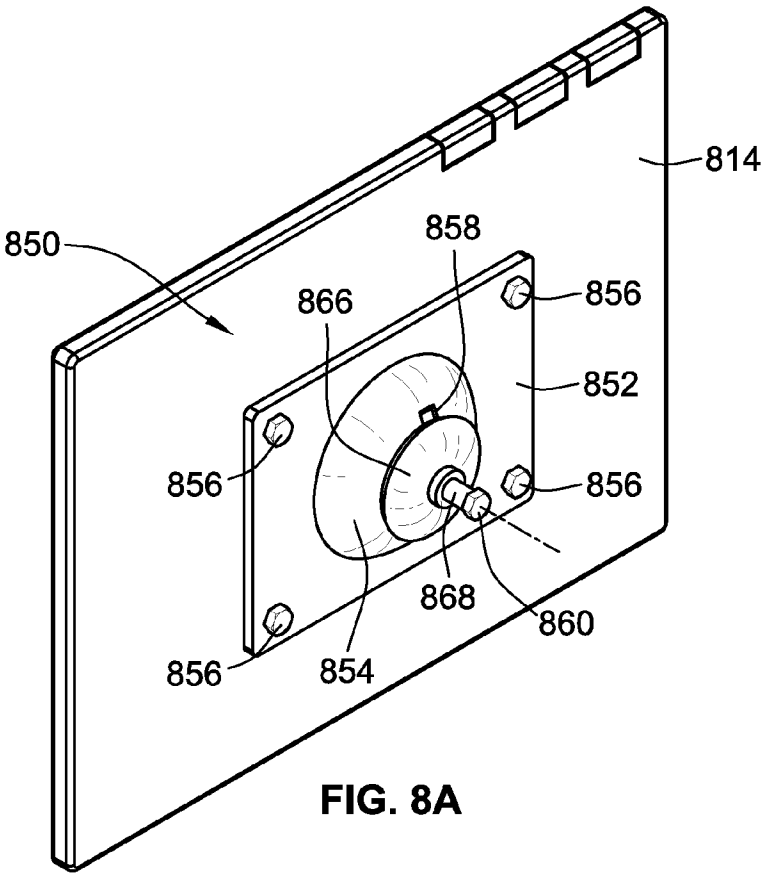
FIG. 8A is a rear perspective-view illustration of an exemplary gaming display device with a mounting bracket in accordance with aspects of the present disclosure.

With reference now to FIGS. 8A and 8B, a representative gaming display device 814 is illustrated with a representative mounting bracket 850 (also referred to herein as "mounting assembly") in accordance with aspects of the present disclosure. Similar to the display devices described above, the gaming display device 814 of FIG. 8 (also referred to herein as "reconfigurable display device") includes an electronic graphical display screen (not visible in the view provided) that is operable to dynamically display information related to the wagering game. The display screen is, in various embodiments, a high-resolution LCD display panel, a plasma display, an LED display panel, an EL panel, or any other type of suitable display device. in addition, the display device 814 is designed to physically change shape and/or size.

The mounting bracket 850 is configured to repositionably mount the gaming display device 814 to a gaming terminal or other support structure. The mounting bracket 850 includes a swivel backing plate 852 with a centrally located, integrally formed dome-shaped portion 854. The swivel backing plate 852 attaches to a rear surface of the display device 814, for example, via four threaded fasteners 856. The dome-shaped portion 854 includes a vertically oriented, elongated slot 858 through which is received a mounting bolt 860. The mounting bolt 860 acts as the interface which mechanically attaches the gaming display device 814 and swivel backing plate 852 to a gaming terminal/support structure.

The mounting bracket 850 also includes a pair of arcuate friction plates 864, 866, each of which is positioned on a respective side of the dome-shaped portion 854. In particular, the first friction plate 864 lies generally flush against the inside surface of the dome-shaped portion 854, whereas the second friction plate 866 lies generally flush against the outside surface of the dome-shaped portion 854 on the opposite side of the first friction plate 864. The friction plates 864, 866 can be fabricated from various materials, including phenol-based ("phenolic") plastics or nylon. The friction plates 864, 866 are drawn together and locked in place by passing the mounting bolt 860 through a bearing surface 868, the second friction plate 866, the elongated slot 858 and then first friction plate 864, and threadably mating the bolt 860 with a fastening nut 862. However, if the bolt 860 is loosened such that there is play between the friction plates 864, 866 and the dome-shaped portion 854 of the swivel backing plate 852, the gaming display device 814 can be reoriented (e.g., selectively turned clockwise or counterclockwise) and/or relocated (e.g., transitioned rectilinearly upward and/or downward along the elongated slot 858).

Also presented herein are improved methods of reconfiguring a display device, such as primary display 514 of FIGS. 5A-5D or secondary display device 616 of FIGS. 6A-6C, of a wagering game terminal, such as gaming terminal 510 of FIGS. 5A-5D or gaming terminal 610 of FIGS. 6A-6C. Some exemplary implementations may include methods of reorienting a display device with respect to the gaming terminal cabinet, methods of relocating a display device on a gaming terminal cabinet, and methods of reshaping a display device of a gaming terminal. The method may include providing the display device, which has an electronic graphical display screen (e.g., electronic graphical display screen 526 of FIG. 5A) that is operable to dynamically display information related to the wagering game. The display screen is configured to change to different shapes and/or different sizes. The method may also include applying a force to the display device such that the display screen changes shape and/or size. The force, in optional embodiments, can be applied manually or can be automated, as described above. In some embodiments, the method further comprises changing the orientation of the display screen with respect to the cabinet. Changing the orientation of the display screen may include moving the display screen from a portrait-view orientation to a landscape-view orientation, or vice-versa. Changing the orientation may also or alternatively include changing the viewing angle of the display screen. In some embodiments, the method further comprises changing the location of the display screen with respect to the cabinet.

In some embodiments, the method includes at least those steps enumerated above. It is also within the scope and spirit of the present invention to omit steps, include additional steps, and/or modify the order presented above.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming terminal for playing a wagering game with a base game portion and a bonus game portion, the gaming terminal comprising:

an input device operable to receive wager inputs and control inputs;

a cabinet; and a display device operatively mounted to the cabinet, the display device having an electronic graphical display screen operable to dynamically display information related to the wagering game, the display screen being configured to physically change shape and orientation in response to events occurring in the wagering game, wherein the display screen automatically changes shape in response to a first event related to the base game portion of the wagering game, and wherein the display screen automatically changes orientation in response to a second event related to the bonus game portion of the wagering game.

2. The gaming terminal of claim 1, wherein the display screen is further configured to change shape or orientation, or both, in response to one or more control inputs received from the player via the input device as part of completing the bonus game portion of the wagering game.

3. The gaming terminal of claim 1, wherein the first event that causes the display screen to automatically change shape is a bonus-game-triggering event occurring in the base game portion of the wagering game, and the second event that causes the display screen to automatically change orientation is a random event occurring in the bonus game portion of the wagering game.

4. The gaming terminal of claim 1, wherein the first event that causes the display screen to automatically change shape is a bonus-game-triggering event occurring in a randomly determined outcome of the base game portion of the wagering game, and the second event that causes the display screen to automatically change orientation is a player input received as part of completing the bonus game portion of the wagering game.

5. The gaming terminal of claim 1, wherein the input device includes a first electronic input device configured to receive a wager input from the player to play the wagering game, and a second electronic input device configured to receive the control input from the player to physically change the shape or orientation, or both, of the display screen.

6. The gaming terminal of claim 1, wherein the display screen automatically changes between a generally arcuate shape for the bonus game portion of the wagering game and a generally flat shape for the base game portion of the wagering game.

7. The gaming terminal of claim 6, wherein the display device further comprises a supporting frame structure configured to retain the display screen in the generally flat shape and in the generally arcuate shape.

8. The gaming terminal of claim 7, further comprising a driving mechanism configured to automate changing the display screen between the generally flat shape and the generally arcuate shape.

9. The gaming terminal of claim 1, wherein the display screen is further configured to change from a first size to a second size.

10. The gaming terminal of claim 1, wherein the display screen physically changes orientation by rotating between a portrait orientation and a landscape orientation.

11. The gaming terminal of claim 10, further comprising a mounting assembly with a mounting disk and a support plate rotatably mounting the display device to the cabinet such that the display screen can selectively rotate between the portrait orientation and the landscape orientation.

12. The gaming terminal of claim 1, wherein the display screen physically changes orientation by transitioning between an upright orientation and a slant-top orientation.

13. The gaming terminal of claim 12, further comprising a mounting assembly with a support plate attached to the display device and a support arm attaching the support plate to the cabinet such that the display screen can selectively transition between the upright orientation and the slant-top orientation.

14. The gaming terminal of claim 1, wherein the display screen is further configured to move from a first location on the cabinet to a second location on the cabinet.

15. The gaming terminal of claim 1, wherein the electronic graphical display screen includes an organic light emitting diode (OLED) panel or a plurality of juxtaposed light emitting diode (LED) tubes.

16. The gaming terminal of claim 1, wherein the display screen is further configured to change shape or orientation, or both, responsive to operator-input preferences.

17. A gaming system for playing a wagering game with a base game portion and a bonus game portion, the gaming system comprising:

at least one input device;

at least one processor;

at least one memory;

at least one support structure; and at least one display device mounted to the at least one support structure, the at least one display device having an electronic graphical display screen operable to dynamically display information related to the wagering game, the display screen being configured to automatically change shape and orientation in response to events occurring in the wagering game, wherein the display screen automatically changes from a first generally flat shape to a second generally arcuate shape in response to a bonus-game-triggering event occurring in the base game portion of the wagering game, and wherein the display screen automatically changes orientation multiple times in response to player inputs or random events, or both, occurring in the bonus game portion of the wagering game.

18. A method of operating a gaming terminal for playing a wagering game with a base game portion and a bonus game portion, the gaming terminal having one or more input devices and one or more display devices, the method comprising:

receiving, via at least one of the one or more input devices, a wager input from a player to play the wagering game;

displaying, via an electronic graphical display screen of at least one of the one or more display devices, a randomly determined outcome of the wagering game, the electronic graphical display screen being configured to physically change shape and orientation responsive to events occurring in the wagering game;

responsive to a first event occurring in the base game portion of the wagering game, directing the display screen to automatically change from a first shape to a second shape; and responsive to a second event occurring in the bonus game portion of the wagering game, directing the display screen to automatically change from a first orientation to a second orientation.

19. The method of claim 18, wherein the display screen is configured to automatically transition between a generally arcuate shape for the bonus game portion of the wagering game and a generally flat shape for the base game portion of the wagering game.

20. The method of claim 19, wherein the changing the shape of the display screen includes directing a driving mechanism to automate transitioning of the display screen between the generally arcuate shape and the generally flat shape.

21. The method of claim 20, wherein the gaming terminal further comprises a supporting frame structure configured to retain the display screen in the generally flat shape and in the generally arcuate shape.

22. The method of claim 18, wherein the display screen is further configured to physically change between a plurality of different sizes.

23. The method of claim 18, wherein the one or more input devices include a first electronic input device configured to receive the wager input from the player to play the wagering game, and a second electronic input device configured to receive the control input from the player to change the shape or orientation, or both, of the display screen.

24. The method of claim 18, further comprising:

determining if a predetermined event occurred during the display of the randomly determined outcome of the wagering game; and responsive to the occurrence of the predetermined event, directing a driving mechanism to automatically change the shape or orientation, or both, of the display screen.

25. A gaming terminal for playing a wagering game, the gaming terminal comprising:

an input device configured to receive an indication of a wager to play the wagering game;

a cabinet; and a display device operatively mounted to the cabinet, the display device having an electronic graphical display screen operable to dynamically display information related to the wagering game, the display screen being configured to automatically transition between a plurality of distinct shapes and orientations in response to events occurring in the wagering game, wherein the display screen automatically transitions to a first distinct shape and orientation to simulate a first predetermined event occurring in the wagering game, and wherein the display screen automatically transitions to a second distinct shape and orientation to simulate a second predetermined event occurring in the wagering game.

* * * * *